United States Patent [19]

Balistrieri

[11] 4,147,354

[45] Apr. 3, 1979

[54] PADDLE BALL GAME

[76] Inventor: Peter A. Balistrieri, 1412 S. Park Ave., Buffalo, N.Y. 14220

[21] Appl. No.: 843,529

[22] Filed: Oct. 19, 1977

[51] Int. Cl.[2] ..... A63B 65/12

[52] U.S. Cl. ..... 273/97 R

[58] Field of Search ..... 273/97 R, 95 A, 58 C, 273/106 R, 99, 98

[56] References Cited

U.S. PATENT DOCUMENTS

| | | | |
|---|---|---|---|
| 1,385,642 | 7/1921 | Restein | 273/58 C X |
| 2,002,631 | 5/1935 | Fiondella | 273/106 R |
| 2,826,861 | 3/1958 | Hoffstadt | 273/106 R |
| 2,950,113 | 8/1960 | Barnack | 273/97 R |
| 3,031,191 | 4/1962 | Bonang | 273/95 A |

FOREIGN PATENT DOCUMENTS

| | | | |
|---|---|---|---|
| 228236 | 11/1910 | Fed. Rep. of Germany | 273/97 R |
| 387008 | 4/1908 | France | 273/97 R |

*Primary Examiner*—George J. Marlo

*Attorney, Agent, or Firm*—Sommer & Sommer

[57] ABSTRACT

A game of skill includes a dumbbell-shaped member having two resilient balls mounted on opposite ends of a dowel, a paddle, and an elastic strand having one end secured to the paddle and having its other end secured to the midpoint of the dowel. The paddle is used to strike a ball to cause the dumbbell-shaped member to rotate. The game depends upon the player's skill in keeping the dumbbell-shaped member rotating.

2 Claims, 2 Drawing Figures

PADDLE BALL GAME

BACKGROUND OF THE INVENTION

1. Field of the Invention

The invention relates to the field of ball games in which a ball is tethered and is struck by some force controlled by the player.

2. Prior Art

Some games provide untethered balls which may be thrown or held in captivity. Other games provide only one ball, tethered and controlled by the player.

SUMMARY OF THE INVENTION

Two bouncing balls are maintained at equal distance from one another by an intermediate dowel. The dowel is inserted into the balls such that the midpoint of the dowel becomes the common center of rotation. An elastic strand has one end tied to the dowel midpoint and has its other end secured to a paddle. With one hand holding up the dowel with the two balls, the other hand with the paddle strikes one of the balls to the floor, to bounce up both balls in gyration. The two balls are suspended by the elastic strand tethered from the dowel to the paddle. The game requires continuity in keeping both balls in gyration.

DETAILED DESCRIPTION

Figure 1:
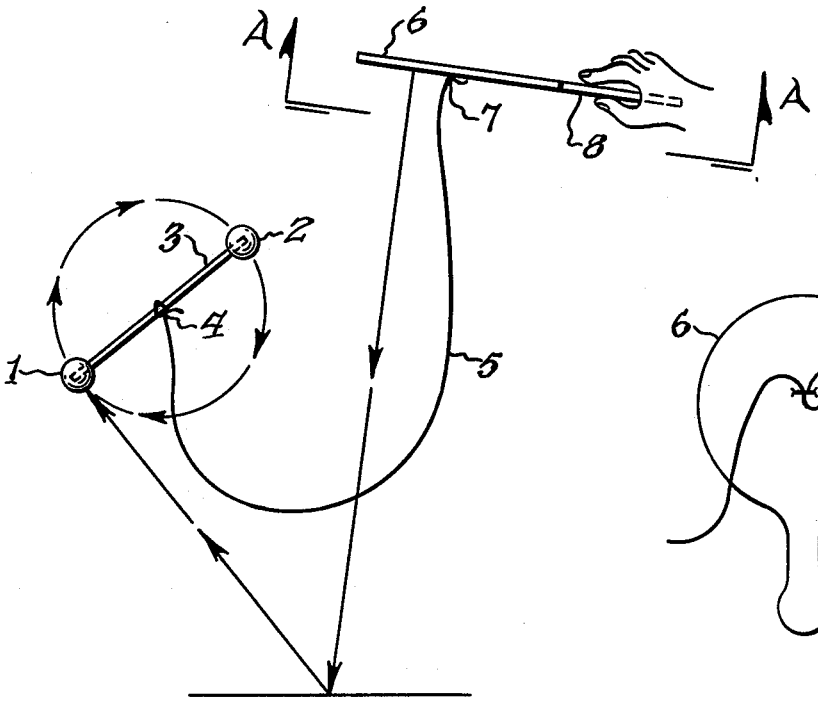
FIG. 1 shows the dumbbell-shaped member, the elastic strand, and the paddle.
Figure 2:
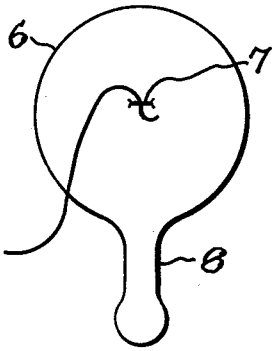
FIG. 2 is a fragmentary view thereof, taken generally on line A—A of FIG. 1

The game includes a dumbbell-shaped member having two balls 1, 2 mounted on the opposite ends of a rod or dowel 3. Balls 1, 2 are made of resilient material, rubber or synthetic for the bouncing action, both being similar and of equal weights. Dowel 3 is a thin rod of wood, or may be a small diameter plastic tube. Dowel 3 is inserted at the center and through the axis of each ball at the extremities of the dowel. Point 4 is the center of gyration of the two balls. An elastic strand 5 of rubber stripping or cord has one end tied to the dowel at midpoint 4 and has its other end fastened or stapled at 7 to the approximate center of paddle 6. Paddle 6 may be laminated wood, composition or plastic and is adapted for striking one of the balls. Paddle 6 includes a handle 8.

What is claimed is:

1. A game of skill, comprising:

a dumbbell-shaped member having two balls mounted on opposite ends of a rod, said dumbbell-shaped member having its center of gravity located at the midpoint of said rod;

a paddle; and an elastic member having one end mounted on the paddle and having its other end secured to said dumbbell-shaped member at said center of gravity;

whereby the user may strike one of said balls with said paddle to cause said dumbbell-shaped member to rotate about said center of gravity.

2. A game of skill as set forth in claim 1 wherein said balls are made of a resilient material.

* * * * *